US005150833A

United States Patent [19]

Hong

[11] Patent Number: 5,150,833

[45] Date of Patent: Sep. 29, 1992

[54] PAPER PACKAGE FOR BEVERAGE

[76] Inventor: Pi-Lien Hong, 5F-5, No. 245, Pa-Der Road Section 2, Taipei, Taiwan

[21] Appl. No.: 848,289

[22] Filed: Mar. 9, 1992

[51] Int. Cl.[5] ..... B65D 5/74

[52] U.S. Cl. ..... 229/125.15; 229/123.1; 229/125.42; 229/215

[58] Field of Search ..... 229/215, 221, 240, 242, 229/243, 125.15, 125.17, 125.37, 125.42, 123.1

[56] References Cited

U.S. PATENT DOCUMENTS

| | | | |
|---|---|---|---|
| 2,819,831 | 1/1958 | Polarek et al. | 229/221 |
| 3,138,315 | 6/1964 | Morrow | 229/125.17 |
| 3,650,458 | 3/1972 | Rausing | 229/125.15 |
| 4,367,828 | 1/1983 | Reil | 229/215 |
| 4,632,299 | 12/1986 | Holmberg | 229/125.15 |
| 4,836,384 | 6/1989 | Tüns et al. | 229/242 |
| 4,915,236 | 4/1990 | Kamin et al. | 229/125.42 |

FOREIGN PATENT DOCUMENTS

| | | | |
|---|---|---|---|
| 1426750 | 12/1965 | France | 229/123.1 |

*Primary Examiner*—Gary E. Elkins

*Attorney, Agent, or Firm*—Darjen International Patent Office

[57] ABSTRACT

Disclosed herein is a sealed hexahedral package made of a piece of paper material by folding and bonding, including a flap consisting of an outer layer extending from its top panel and an inner layer extending from its side panel, lapped and adhered to the side panel so that the outer layer is covering the inner layer, where a pour spout is opened; and a protuberance made of soft material adhered to the side panel to block and seal the pour spout so that after the flap is pulled upwards, the pour spout is exposed, and the protuberance remains adhered to the side panel.

2 Claims, 6 Drawing Sheets

PAPER PACKAGE FOR BEVERAGE

BACKGROUND OF THE INVENTION

1. Field of the Invention

The present invention related to a paper package for beverage, particular a paper package which permits easy pouring out of beverage from it.

2. Description of the Prior Art

Traditionally, paper package for beverage is made of non-toxic and water-proof paper material by folding and bonding, as shown in FIG. 8, a conventional sealed package for beverage. To a conventional paper package 90 of considerable large capacity, it is required to pull up a flap 92 and then cut along a line 96 with a pair of scissors 94 to form a pour spout (not shown) for pouring out of beverage from the package 90. In other words, scissors or other similar tool is required to open the package 90 before the beverage can be poured out. Therefore, it is quite inconvenient in using of such paper package.

Hence, design of paper package of considerable large capacity and permitting pouring out of beverage without need of any tool to open the package is urgently needed by the general consumers.

SUMMARY OF THE INVENTION

The paper package for beverage according to the present invention is a sealed hexahedral package made of non-toxic and water-proof paper material by folding and bonding. Its top panel has a first triangular flap and a second triangular flap formed by folding of a part of the top panel and a side panel, each extended from a side of said top panel, and adhered to a side panel; its bottom panel has a third triangular flap and a fourth triangular flap formed by folding of a part of said bottom panel and a side panel, each extended from a side of said bottom panel, and adhered to a side panel; and each of the said triangular flaps consists of an inner wall and an outer layer covering the inner wall. A pour spout is opened at the inner wall in one of the flap on the top, and a protuberance made of soft material slightly greater than the size of the pour spout is adhered on the side panel at a position corresponding to the pour spout so that when the flap is adhered to the side panel, the protuberance can block and tightly seal the pour spout to prevent the beverage filled in the package from flowing out, and to isolate the beverage in the package from the atmosphere. To open the package, only the flap is pulled up by hand to expose the pour spout but the protuberance remains adhered to the side panel and the beverage can be poured out easily.

Therefore, the main objective of the present invention is to provide a paper package for beverage which can be opened by hand without aid of any tool so that beverage in it can be poured out conveniently and easily.

Another objective of the present invention is to provide a paper package for beverage which can be opened without scissors or other tool to prevent from contamination by foreign particles attached on the scissors or tool, such as rust. Such foreign particles may leave on the opening of the package if the package is opened by means of scissors or tool, and may then entering human body following the flow of beverage. Therefore, the prevent invention provides a paper package to assure healthy condition.

BRIEF DESCRIPTION OF THE DRAWINGS

The invention as well as its many advantages may be further understood by reference to the following detailed description and drawings in which.

DETAILED DESCRIPTION OF THE PREFERRED EMBODIMENT

Figure 1:
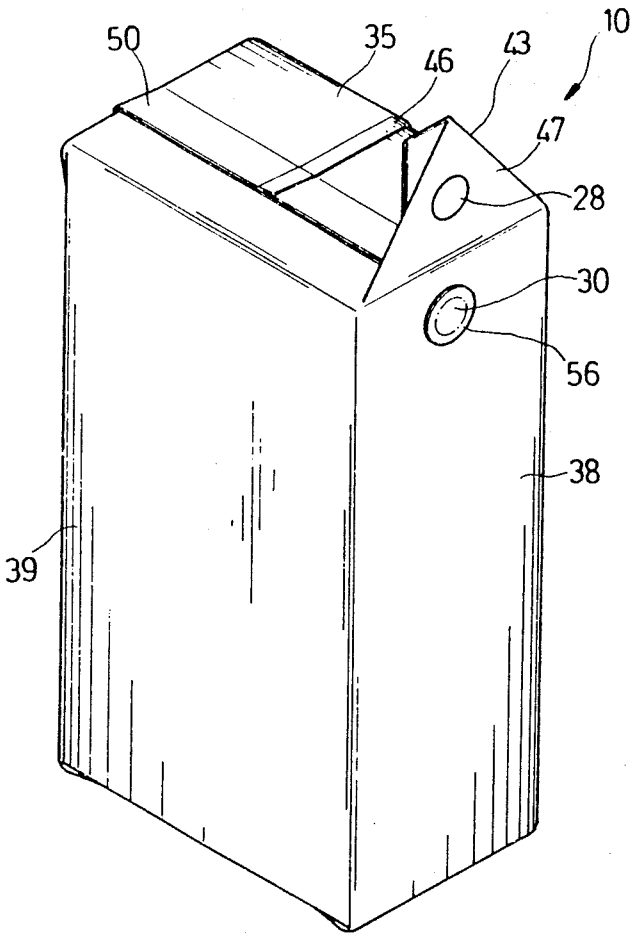
FIG. 1 is a perspective view of a paper package for beverage according to the present invention, in which a top flap has been pulled up and a pour spout is exposed.
Figure 2:
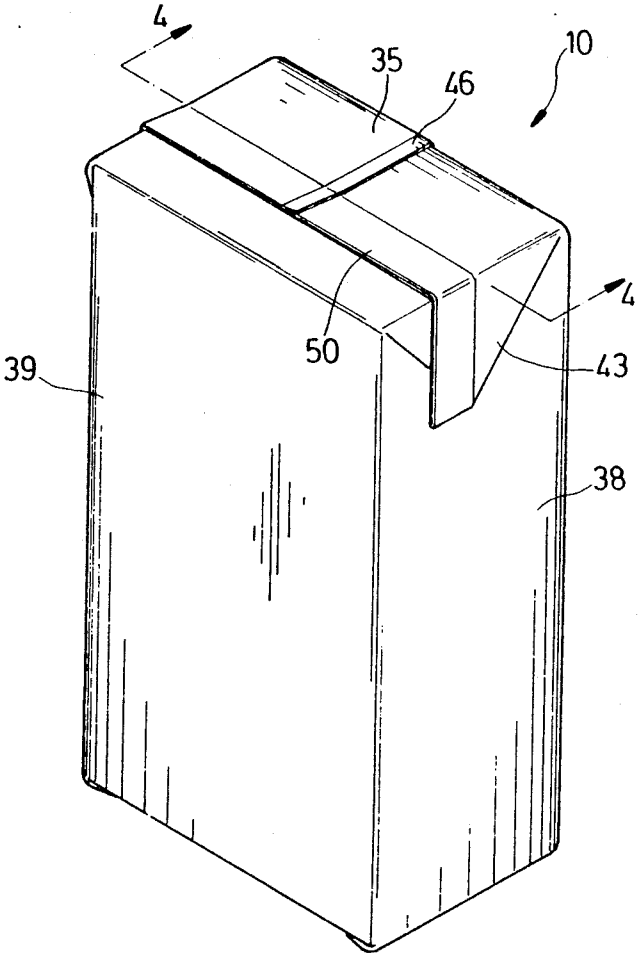
FIG. 2 is a perspective view of the paper package for beverage in FIG. 1, but the top flap has been folded and adhered to a side panel of the package.

Please refer to FIGS. 1 through 4, the beverage package 10 according to the present invention is made by folding of a non-toxic and water-proof paper 12. The beverage package 10 is substantially a sealed hexahedral container as shown in FIG. 2. Please refer to FIGS. 2 and 4, the package 10 has a front panel 39, a back panel 54 (see FIG. 5), a left side panel 37, a right side panel 38, a top panel 35, and a bottom panel 36. The top panel 35 has a first triangular top flap 42 extending from its left side, and a second triangular top flap 43 extending from its right side. These two top flaps 42 and 43 are folded downwards and adhered to the side panels 37 and 38 respectively. Each of the side panels 37 and 38 has a third or fourth triangular bottom flap 44 or 45 extending downwards, folded and adhered to the bottom panel 36. The package 10 also includes a traverse top tuck flap 50 between the first top flap 42 and the second top flap 43, a traverse bottom tuck flap (not shown) between the third bottom flap 44 and the fourth bottom flap 45, and a back tuck flap 46 from a top tuck flip 31 to a bottom tuck flap 32. Each of the triangular flaps includes substantially an external layer, and an interior wall covered by the external layer.

Figure 3:
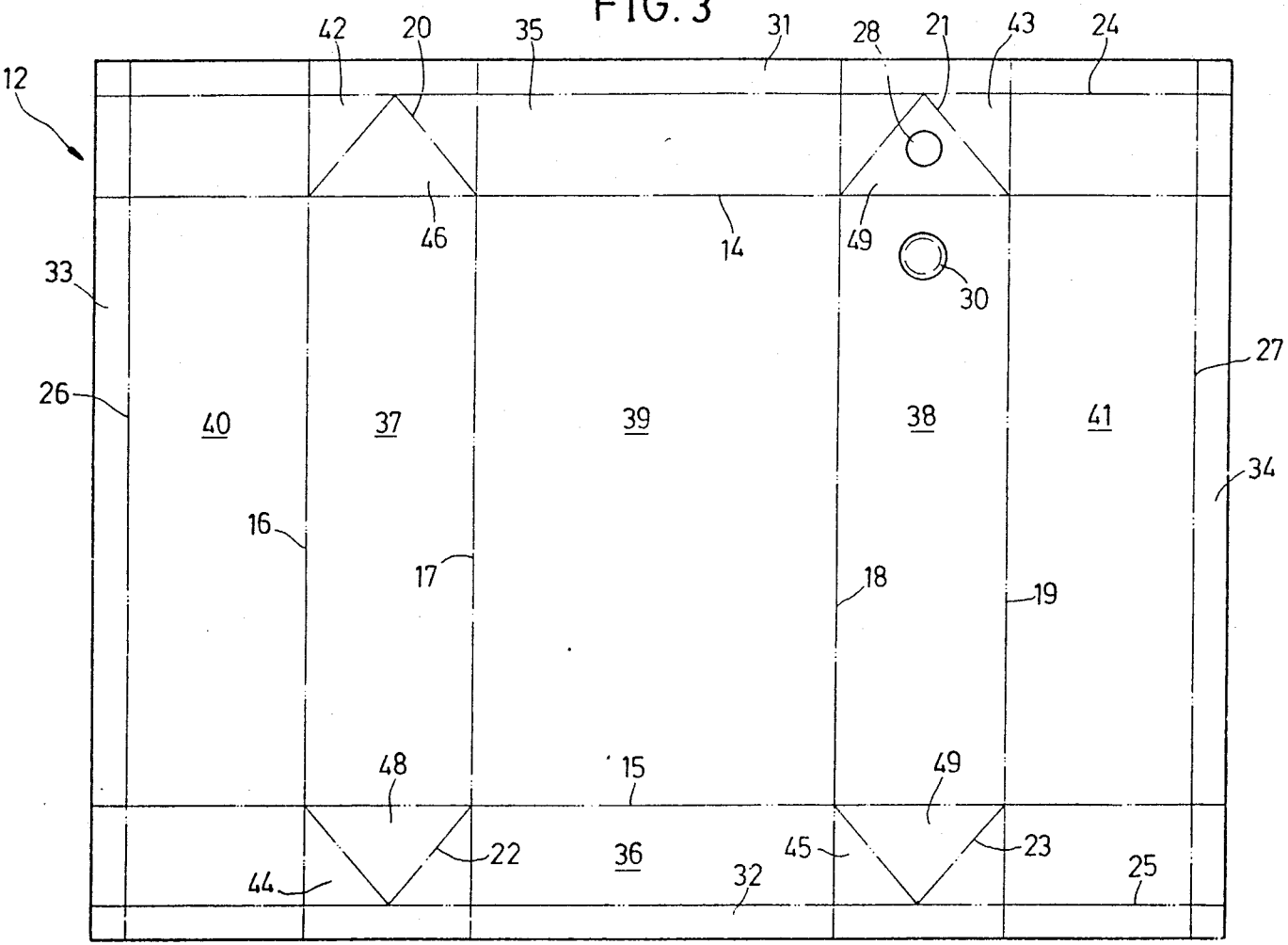
FIG. 3 is a developed view of the paper package for beverage according to present invention.

FIG. 3 illustrates a piece of paper material 12 for folding to make the package 10. On the paper material 12 there are first and second horizontal folding lines 14 and 15 (from top to bottom), first to fourth perpendicular folding lines 16 to 19 (from left to right), first to fourth V-folding lines 20 to 23, and first to fourth adhering lines 24 to 27 around the paper material 12. A pour spout 28 is opened in the area defined by the second V-folding line 21 and the first horizontal folding line 14. Beneath the first horizontal folding line 14, a protuberance made of soft material slightly greater than the size of the pour spout 28 is adhered at a position corresponding to the pour spout (28). The adhering lines 24 to 27 defines the first to fourth adhesive zones 31 to 34 respectively on the outer edges. The first horizontal folding line 14 and the first adhering line 24 define the top panel 35. The second folding line 15 and the second adhesive line define the bottom panel 36. The folding lines 14, 15, 16 and 17 define the left side panel 37. The folding lines 14, 15, 18 and 19 define the right side panel 38. The folding lines 14, 15, 17 and 18 define the front panel 39. The folding lines 14, 15 and 16 and the third adhering line 26 define the left half part 40 of the back panel. The folding lines 14, 15 and 19 and the fourth adhesive line 27 define the right half part 41 of the back panel. The folding lines 14, 16 and 17 and the first adhesive line define the first flap 42, on which the folding lines 14 and 20 define an inner wall 46, while the remaining portion is its outer layer. The folding lines 14, 18 and 19 and the first adhering line 24 define the second flap 43, on which the folding lines 14 and 21 define an inner wall 47, while the remaining portion is its outer layer, and the pour spout 28 is opened at the inner wall 47. The folding lines 15, 16 and 17 and the second adhering line 25 define the third flap 44, on which the folding lines 15 and 22 define an inner wall 48, while the remaining portion is its outer layer. The folding lines 15, 18 and 19 and the second adhesive line 25 define the fourth flap 45, on which the folding lines 15 and 23 define an inner wall 49, while the remaining portion is its outer layer.

The hexahedral package 10 according to the present invention can be formed by folding of the paper material 12 along the folding lines 14 to 23. After such folding, the third and the four adhering zones 33 and 34 are overlapped and adhered to each other by means of adhesive to become a back adhering zone 46 of the package 10. The first adhering zone 31 is lapped and bonded with adhesive to become a bottom adhesive zone (not shown in the drawings) of the package 10.

Figure 4A:
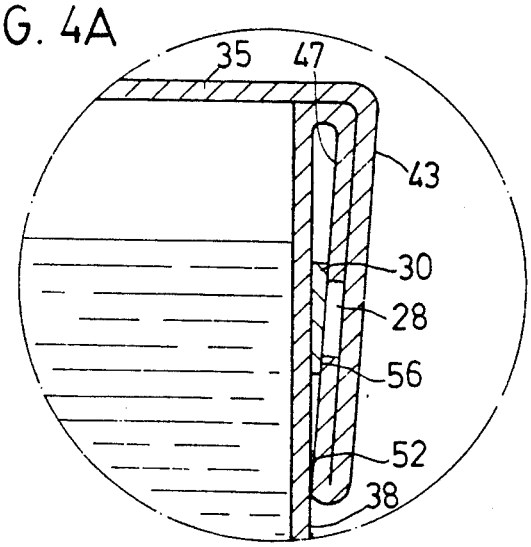
FIG. 4A is a magnified view of the part A in FIG. 4.
Figure 4:
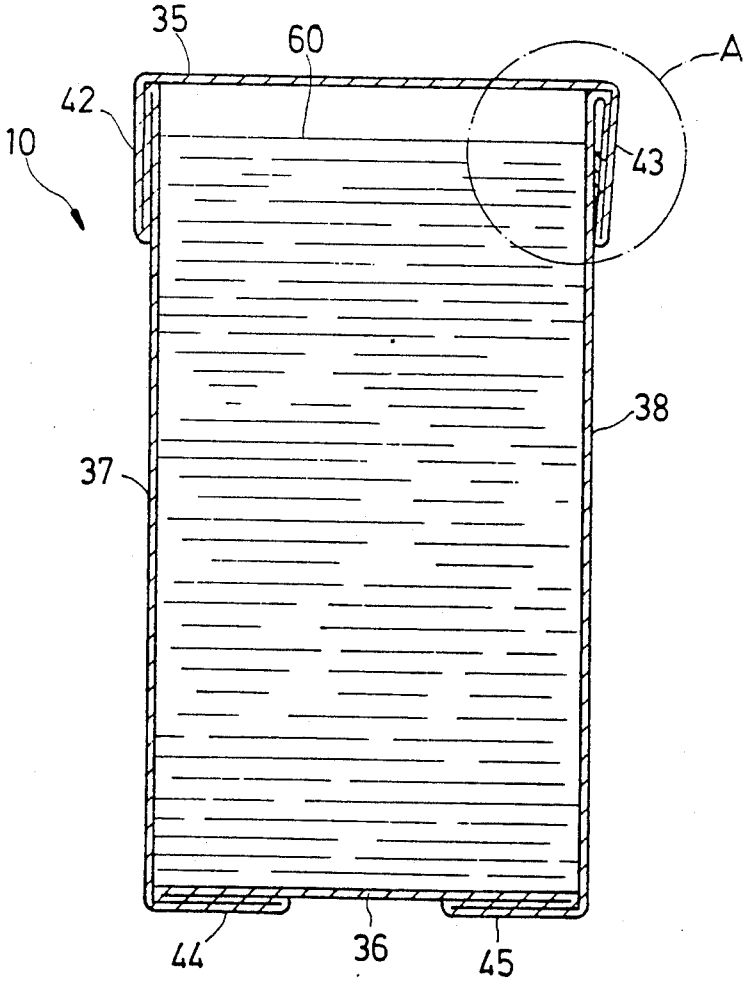
FIG. 4 is a cross-sectional view along the line 4—4 in FIG. 2.

As shown in FIG. 4A, the second flap 43 is folded downwards, and its lower end 52 is applied with adhesive for adhesion to the right side panel 38 so that the pour spout 28 at the inner wall of the second flap 43 is entirely blocked and sealed by the protuberance 30 adhered to the right side panel 38 to prevent from flowing out of beverage filled in the package 10, and to prevent from entry of air through the pour spout 28 into the package 10. If necessary, adhesive of lower adhesive strength is applied on the periphery 56 of the protuberance 30 for contacting with the inner wall 47 (see FIG. 1) in order to provide additional air-tightening effect when the pour spout 28 is blocked by the protuberance 30. Moreover, another pour spout and protuberance made of soft material can be designed at the first flap 42 and the left side panel 37.

Figure 5:
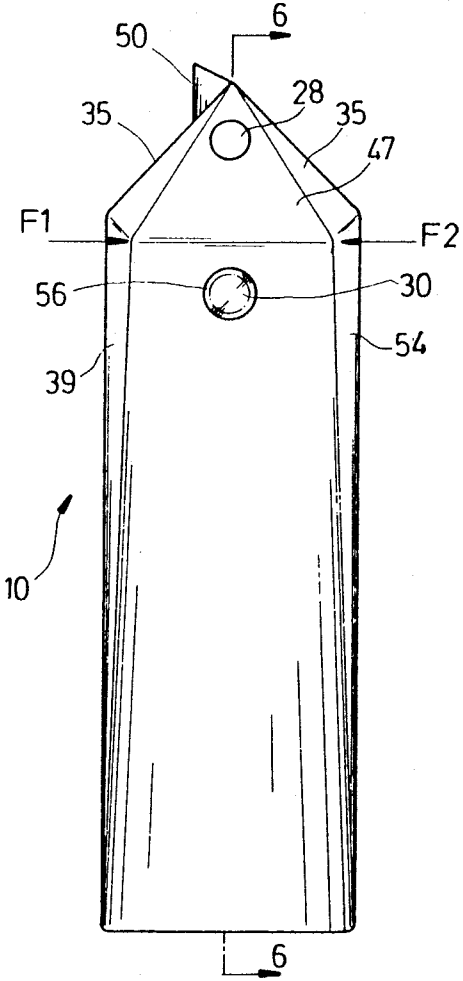
FIG. 5 is a right side view of the paper package for beverage in FIG. 1, but the side panels have been squeezed and tends to decline slightly.
Figure 6:
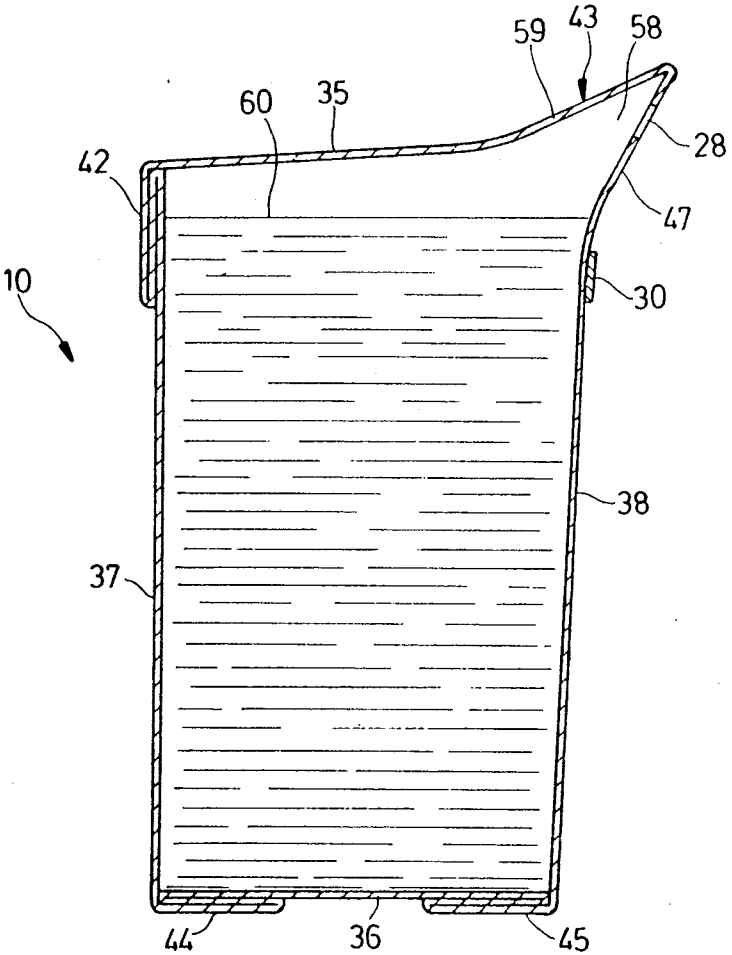
FIG. 6 is a cross-sectional view along the line 6—6 in FIG. 5.
Figure 7:
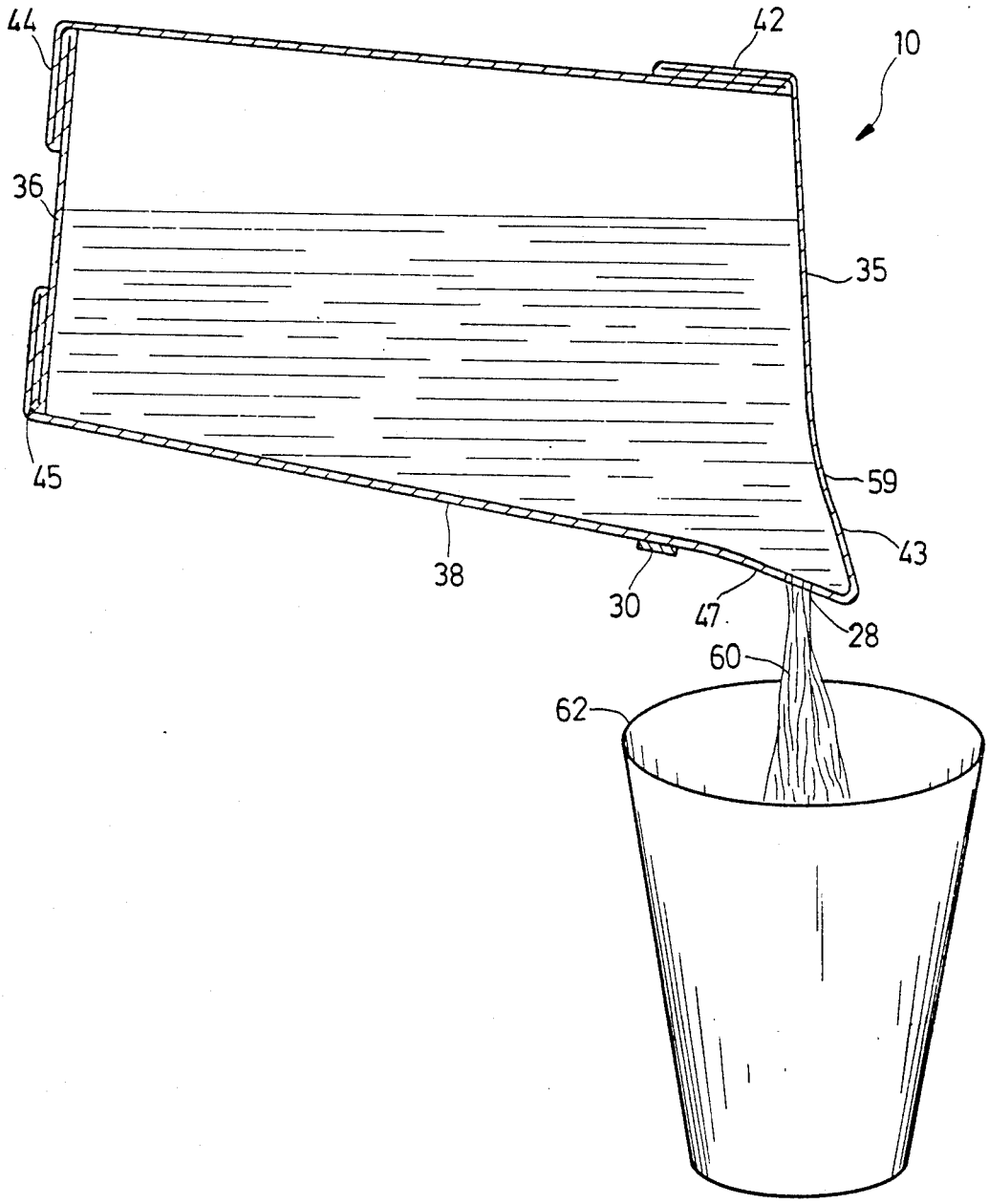
FIG. 7 illustrates the paper package for beverage in FIG. 6, but the package is held in a horizontal level so that beverage is flowing out of the package into a glass.
Figure 8:
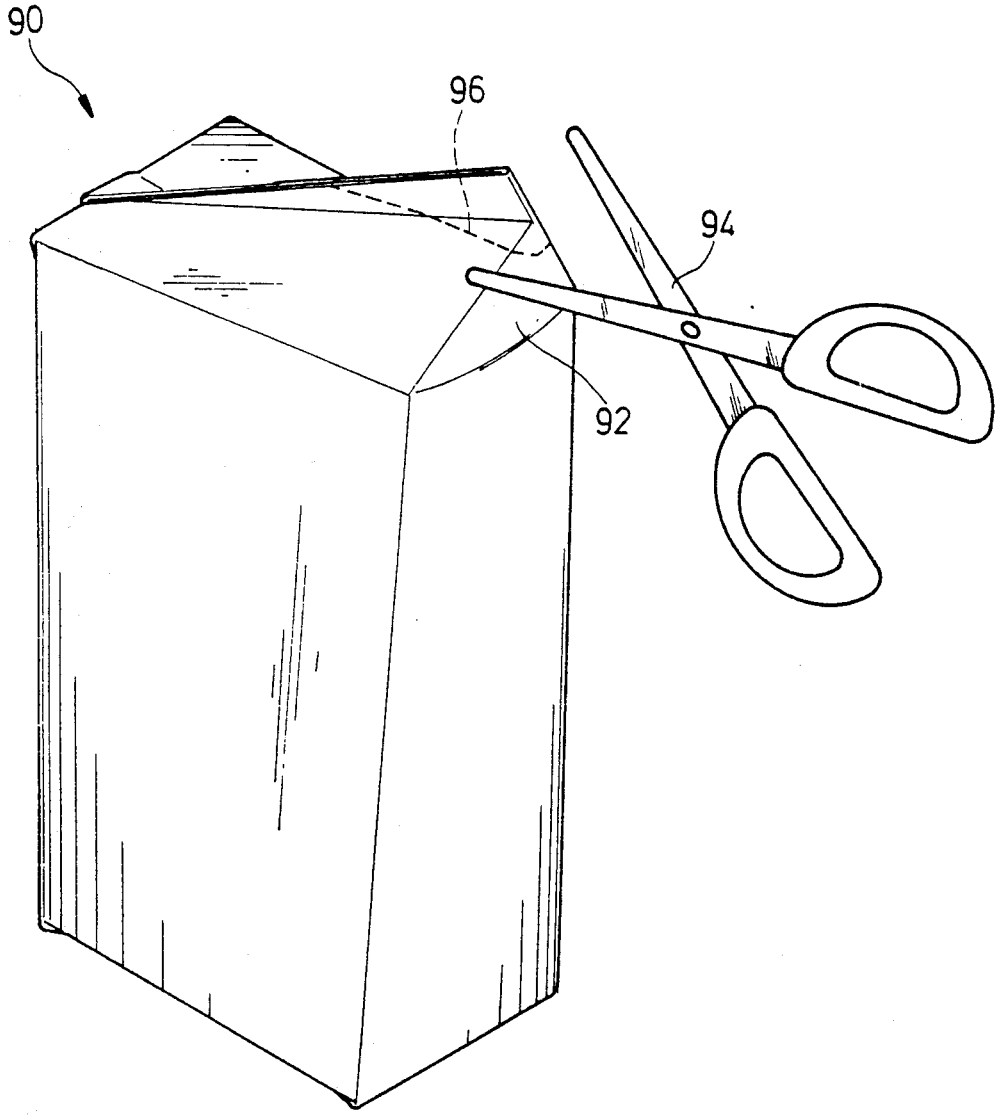
FIG. 8 Prior Art
FIG. 8 is a perspective view of a traditional paper package for beverage being opened by a pair of scissors.

To pour beverage 60 out of the sealed paper package 10 as shown in FIG. 2, the second flap 43 can be pulled upwards by hand without aid of any tool to become a condition as shown in FIG. 1, the pour spout 28 at the inner wall 47 of the second flap is exposed, but the protuberance 30 remains adhering to the right side panel 38. Then, as illustrated in FIG. 5, the right side penal is squeezed with fingers in two opposite directions as shown in the arrows F1 and F2 so that the package 10 is squeezed to a condition as shown in FIG. 6, in which the right side panel 38 tends to slightly decline outwards and the top panel 35 tends to slightly decline upwards so that a space 58 for passing through of the beverage 60 is formed after separation of the inner wall 47 from the outer layer 59 at the second flap 43. Finally, the package 10 is held at a substantially horizontal level as shown in FIG. 7 to pour the beverage 60 through the pour spout 28 into another container such and glass for serving purpose.

The paper package described above can be opened without any tool and then beverage in it can be poured out easily. It is more practical and convenient than the prior art and its application can assure storage of beverage at highly healthy condition.

Having described my invention as related to the embodiment shown in the accompanying drawings, it is my intention that the invention be not limited by any of the details of description, unless otherwise specified, but rather be construed broadly within its spirit and scope as set out in the appended claims.

What is claimed is:

1. A paper package for beverage in the form of a sealed hexahedral package made of a piece of paper material by folding and bonding, in which said hexahedral package having a front panel, a back panel, a left side panel, a right side panel, a top panel, and a bottom panel; said top panel having a first triangular flap and a second triangular flap formed by folding of a part of said top panel and a side panel, each extended from a side of said top panel, and adhered to a side panel; said bottom panel having a third triangular flap and a fourth triangular flap formed by folding of a part of said bottom panel and a side panel, each extended from a side of said bottom panel, and adhered to a side panel; and each of the said triangular flaps consisting of an inner wall and an outer layer covering said inner wall; and characterized by at least one of the triangular flap having a pour spout opened at the inner wall; and a protuberance made of soft material slightly greater than the size of said pour spout, adhered on a side panel at a position corresponding to the pour spout to block and seal said pour spout; and said protuberance remaining adhered to said side panel after the flap with said pour spout has been pulled upwards.

2. A paper package for beverage as claimed in claim 1 wherein the protuberance of soft material having a periphery to contact with the inner wall where the pour spout is opened and said periphery is applied with an adhesive for adhesion to said inner wall.

* * * * *